US007659874B2

(12) United States Patent
Koyama

(10) Patent No.: US 7,659,874 B2
(45) Date of Patent: Feb. 9, 2010

(54) DRIVING DEVICE FOR LIQUID CRYSTAL PANEL AND IMAGE DISPLAY APPARATUS

(75) Inventor: Fumio Koyama, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 703 days.

(21) Appl. No.: 11/356,001

(22) Filed: Feb. 17, 2006

(65) Prior Publication Data

US 2006/0214928 A1 Sep. 28, 2006

(30) Foreign Application Priority Data

Mar. 9, 2005 (JP) ..... 2005-064998

(51) Int. Cl.
*G09G 3/36* (2006.01)

(52) U.S. Cl. ..... 345/87

(58) Field of Classification Search ..... 345/87–111, 345/204, 212, 213, 441, 660, 690; 349/149; 315/169.1
See application file for complete search history.

(56) References Cited

U.S. PATENT DOCUMENTS 5,748,335 A * 5/1998 Honma et al. ..... 358/445
5,831,586 A * 11/1998 Hirai et al. ..... 345/94
6,160,532 A * 12/2000 Kaburagi et al. ..... 345/87
6,288,699 B1 * 9/2001 Kubota et al. ..... 345/99
6,340,964 B1 * 1/2002 Nakazawa et al. ..... 345/100
7,027,025 B2 * 4/2006 Takeda ..... 345/96
7,142,182 B2 * 11/2006 Aoki et al. ..... 345/87
7,375,711 B2 * 5/2008 Horiuchi et al. ..... 345/89
7,518,622 B2 * 4/2009 Ochi ..... 345/690

FOREIGN PATENT DOCUMENTS

JP A 11-282426 10/1999

* cited by examiner

*Primary Examiner*—Srilakshmi K Kumar
(74) *Attorney, Agent, or Firm*—Oliff & Berridge, PLC

(57) ABSTRACT

A driving device for a liquid crystal panel having a signal generating circuit; a reference signal generating circuit; a phase comparator that compares phases of an inputted monitor signal and the reference signal and outputs phase comparison information; and an adder. The adder outputting an integrated count value for adjusting timing for generating the start signal on the basis of an initial count value set in advance and the phase comparison information from the phase comparator. The signal generating circuit generates plural timing signals including the start signal with the horizontal synchronizing signal as a trigger and with timing based on the integrated count value as a start point and supplies the timing signals to the liquid crystal panel.

7 Claims, 7 Drawing Sheets

DRIVING DEVICE FOR LIQUID CRYSTAL PANEL AND IMAGE DISPLAY APPARATUS

BACKGROUND

1. Technical Field

The present invention related to a driving device for a liquid crystal panel of an active matrix driving system according to thin film transistor (hereinafter referred to as TFT) driving or the like and an image display apparatus including the driving device.

2. Related Art

For example, an electronic apparatus disclosed in JP-A-11-282426 is known as the image display apparatus using the liquid crystal panel of the active matrix driving system according to TFT driving. FIG. 7 is a schematic diagram of a liquid crystal panel 202 provided in the electronic apparatus disclosed in JP-A-11-282426 and a driving device 203 for the liquid crystal panel.

In the liquid crystal panel 201, a large number of scan lines Y1 to Ym and data lines X1 and Xn, which are arranged vertically and horizontally, respectively, and a large number of pixel electrodes 240 corresponding to respective intersections of the scan lines and the data lines are provided on a glass substrate. In addition to the scan lines, the data lines, and the pixel electrodes 240, peripheral circuits such as a scan line driver 230, a data line driver 220, sampling circuits SH1 to SHn, and pixel TFT circuits ST1 to STn are provided on the glass substrate. Moreover, liquid crystal cells corresponding to the respective pixel electrodes are filled between two opposed glass substrates to form the liquid crystal panel 201.

The driving device 203 is a signal generating circuit including a frequency dividing circuit or the like. An operation clock CLK and a horizontal synchronizing signal HSYNC and a vertical synchronizing signal VSYNC of an image signal are supplied to the driving device 203. The driving device 203 generates a start signal DX, a clock signal CLX, an inverted clock signal CLXN, an enable signal ENBX, and the like serving as timing signals on the basis of the operation clock CLK with the horizontal synchronizing signal HSYNC as a trigger.

The data line driver 220 including selection circuits L1 to Ln generates sampling signals S1 to Sn for determining driving timing for the sampling circuits SH1 to SHn on the basis of plural timing signals supplied from the driving device 203.

The sampling circuit SH1 to SHn including switching elements such as TFTs outputs image signals VID1 to VID6, which are expanded into six phases, to the pixel TFT circuits ST1 to STn only for a period in which the sampling signals S1 to Sn are at a high level.

Scan signals Y1 to Yn outputted from the scan line driver 230 are inputted to the pixel TFT circuits ST1 to STn. The pixel TFT circuits ST1 to STn outputs the image signals VID1 to VID6 to the pixel electrodes 240 only for a period in which the scan signals Y1 to Yn are at a high level. In this way, a video represented by the image signals VID1 to VID6 is displayed on the liquid crystal panel 201.

In the liquid crystal panel 201, when characteristics of a shift register included in the data line driver 220 and transistors constituting NAND circuits and the like of the selection circuits L1 to Ln are deteriorated, overlap occurs among the sampling signals S1 to Sn and a ghost image may be displayed.

In view of such a problem, the electronic apparatus disclosed in JP-A-11-282426 adjusts the period in which the sampling signals S1 to Sn are at a high level according to the enable signal ENBX to eliminate the overlap of the sampling signals S1 to Sn and prevent a ghost from being caused.

The ghost image may also be caused because of shift between a period in which the image signals VID1 to VID6 reach a saturated level and the period in which the sampling signals S1 to Sn are at a high level.

The image signals VID1 to VID6 are integrated by an internal circuit of the liquid crystal panel 201, whereby an edge of a waveform thereof is blunted. Therefore, if the period in which the image signals VID1 to VID6 reach a saturated level and the period in which the sampling signals S1 to Sn are at a high level do not coincide with each other, a ghost image is displayed.

The period in which the sampling signals S1 to Sn are at a high level may temporally shift from the period in which the image signals VID1 to VID6 reach a saturated level because characteristics of circuit elements and the like constituting data line driver 220 and the sampling circuits SH1 to SHn change as a result of a temperature change and aged deterioration at the time when the liquid crystal panel 201 is used.

In the electronic apparatus disclosed in JP-A-11-282426, it is possible to prevent a ghost image due to overlap of the sampling signals S1 to Sn from being caused. However, JP-A-11-282426 does not take into account a ghost image caused by shift between the period in which the image signals VID1 to VID6 reach a saturated level and the period in which the sampling signals S1 to Sn are at high level. The latter period changes as a result of a temperature change and aged deterioration at the time when the liquid crystal panel 201 is used.

A ghost image caused by temporal shift between a period in which images signals reach a saturated level and a period in which sampling signals are at a high level will be explained.

FIG. 6A is a diagram showing an appropriate image in which a ghost image is not caused and states of image signals representing the image and sampling signals.

A black substantially square window pattern 301 is displayed with a light gray background in an image 300 represented by an image signal VID. The image signal VID is expanded into six phases and supplied to the liquid crystal panel 201 as the image signals VID1 to VID6.

The image signals VID1 to VID6 are represented by a waveform having a voltage level (3V) indicating light gray and a voltage level (2V) indicating black. The image signals VID1 to VID6 are integrated by the internal circuit of the liquid crystal panel 201, whereby the edge of the waveform thereof is blunted. Thus, the image signals VID1 to VID6 need to be outputted to the pixel TFT circuits ST1 to STn in the period in which the image signals VID1 to VID6 reach a saturated level (e.g., a period as late as possible in image signal periods Ta and Tb).

A period Qa in which a sampling signal Sk is at a high level (a high-level period Qa of a sampling signal Sk) determines timing for inputting the image signals VID1 to VID6 to pixel TFT circuits corresponding to pixels P1 to P6 on a left side of the window pattern 301.

The high-level period Qa temporally coincides with a period in which the image signals VID1 to VID6 reach a saturated level (3V) of light gray in the image signal period Ta. The image signals VID1 to VID6 representing light gray are inputted to respective pixel electrodes of the pixels P1 to P6.

A period Qb in which a sampling signal Sk+1 is at a high level (a high-level period Qb of a sampling signal Sk+1) determines timing for inputting the image signals VID1 to VID6 to pixel TFT circuits corresponding to pixels P7 to P12 in the window pattern 301.

The high-level period Qb temporally coincides with a period in which the image signals VID1 to VID6 reach a saturated level (2V) of black in the image signal period Tb. The image signals VID1 to VID6 representing black are inputted to respective pixel electrodes of the pixels P7 to P12.

Thus, in a state shown in FIG. 6A, a ghost is not caused at the left end of the window pattern 201.

A line of the pixels P1 to P12 has been explained as an example. However, images are displayed at the same timing not only on the line but also on all lines on the liquid crystal panel 201. Thus, a ghost is not caused in the image 300 as a whole.

FIG. 6B is a diagram showing an image in which a ghost is caused because sampling signals are temporally ahead of image signals and states of the image signals representing the image and the sampling signals.

In FIG. 6B, the sampling signals Sk and Sk+1 temporally advance because of influences of a temperature change and aged deterioration of the liquid crystal panel 201. Thus, a part of the high-level period Qb shifts from the saturated level (2V) of black in the image signal period Tb in the image signals VID1 to VID6 and temporally overlaps a voltage level close to light gray.

Therefore, a part of the image signals VID1 to VID6 of the voltage level close to light gray are inputted to the respective pixel electrodes of the pixels P7 to P12 other than the image signals VID1 to VID6 that reach the saturated level (2V) of black. As a result, the image signals are mixed to cause a ghost of dark gray A on an inner side of the left side of the window pattern 301.

At this point, the same phenomenon occurs in continuous six pixels on an outer side of a right side of the window pattern 301. A part of the image signals VID1 to VID6 of the voltage level close to light gray are inputted to respective pixel electrodes on the right side other than the image signals VID1 to VID6 that reach the saturated level (2V) of black. As a result, the image signals are mixed to cause a ghost of dark gray B on the outer side of the right side of the window pattern 301 as well.

Moreover, the ghost is caused not only on the line of the pixels P6 to P12 but also on all the lines on the liquid crystal panel. Thus, a ghost of the dark gray A is caused on the inner side of the left side of the window pattern 301 and a ghost of dark gray B is caused on the outer side of the right side of the window pattern 301. Color strengths of the thick gray A and the thick gray B vary depending on a degree of temporal advance of the sampling signals Sk and Sk+1.

FIG. 6C is a diagram showing an image in which a ghost is caused because sampling signals are temporally delayed behind image signals and states of the image signals representing the image and the sampling signals.

In FIG. 6C, the sampling signals Sk and S+1 are temporally delayed behind the image signals VID1 to VID6 because of influences of a temperature change and aged deterioration of the liquid crystal panel 201. Thus, a part of the high-level period Qa shifts from the saturated level (3V) of light gray in the image signal period Ta in the image signals VID1 to VID6 and temporally overlaps a voltage level close to black.

Therefore, a part of the image signals VID1 to VID6 of the voltage level close to black are inputted to the respective pixel electrodes of the pixels P1 to P6 other than the image signals VID1 to VID6 that reach the saturated level (3V) of light gray. As a result, the image signals are mixed to cause a ghost of dark gray C on the outer side of the left side of the window pattern 301.

At this point, the same phenomenon occurs in continuous six pixels on an inner side of the right side of the window pattern 301. A part of the image signals VID1 to VID6 of the voltage level close to black are inputted to the respective pixel electrodes on the right side other than the image signals VID1 to VID6 that reach the saturated level (3V) of light gray. As a result, the image signals are mixed to cause a ghost of dark gray D on the inner side of the left side of the window pattern 301.

Moreover, the ghost is caused not only on the line of the pixels P6 to P12 but also on all the lines on the liquid crystal panel. Thus, a ghost of the dark gray C is caused on the inner side of the left side of the window pattern 301 and a ghost of dark gray D is caused on the outer side of the right side of the window pattern 301. Color strengths of the thick gray C and the thick gray D vary depending on a degree of temporal advance of the sampling signals Sk and Sk+1.

In the above explanation, the liquid crystal panel 201 is applied to monochrome display. However, the phenomenon described above occurs even if the liquid crystal panel 201 is applied to color display.

For example, when the liquid crystal panel 201 is a liquid crystal panel applied to color display that colors transmitted light using a color filter of R (red), G (green), or B (blue) for each of the pixels, one color is formed by three continuous pixels. Thus, the three continuous pixels are equivalent to one pixel of the liquid crystal panel applied to monochrome display.

As described above, the electronic apparatus in the past has a problem in that it is difficult to completely prevent a ghost due to temporal shift of timing signals caused by a temperature change and aged deterioration at the time when the liquid crystal panel is used.

SUMMARY

An advantage of some aspects of the invention is to provide a driving device for a liquid crystal panel and an image display apparatus that can obtain, with a simple constitution, a clear image without a ghost even if a characteristic of an internal circuit of the liquid crystal panel changes because of influences of a temperature change and aged deterioration.

According to an aspect of the invention, there is provided a driving device for a liquid crystal panel including: plural liquid crystal cells arranged in a matrix shape; pixel electrodes provided for the respective liquid crystal cells; plural data lines for inputting an image signal to the respective pixel electrodes; a data line driver that generates a sampling signal for sampling the image signal from inputted plural timing signals; plural sampling circuits provided for the respective data lines that sample the image signal according to the sampling signal and output the image signal to the data lines; and a dummy element formed on, at least, a substrate identical with a substrate on which the sampling circuits are formed. The driving device for a liquid crystal panel includes: a signal generating circuit that generates, as the plural timing signals, a start signal and other signals generated with the start signal as a reference of a phase; a reference signal generating circuit that generates a reference signal with a horizontal synchronizing signal of an image signal as a trigger and with timing after elapse of a predetermined time as a start point; a phase comparator that compares phases of an inputted monitor signal and the reference signal and outputs phase comparison information; and an adder that outputs an integrated count value for adjusting timing for generating the start signal on the basis of an initial count value set in advance and the phase comparison information from the phase comparator. The signal generating circuit generates plural timing signals including the start signal with the horizontal synchronizing signal as a trigger and with timing based on the integrated count value as a start point and supplies the timing signals to the liquid crystal panel.

According to the constitution, the dummy element is formed on, at least, the substrate identical with the substrate on which the sampling circuits are formed. Thus, the dummy element includes parasitic capacitance, wiring resistance, and the like same as those of the sampling circuits and has a transmission characteristic of the timing signal substantially equivalent to that of the sampling circuits.

Therefore, a change in a transmission characteristic of an internal circuit of the liquid crystal panel due to influences of a temperature change and aged deterioration is reflected on a monitor signal outputted through the dummy element.

The signal generating circuit generates the plural timing signals including the start signal with the horizontal synchronizing signal as a trigger and with timing based on the integrated count value as a start point and supplies the timing signals to the liquid crystal panel. Thus, the driving device for a liquid crystal panel generates the start signal serving as a reference of a phase of the timing signals at timing when time, which corresponds to an integrated count value obtained by adding the phase comparison information outputted by comparing the phases of the monitor signal and the reference signal to an initial count value, elapses.

The integrated count value is obtained by adding the phase comparison information of the reference signal, which has a phase fixed with the horizontal synchronizing signal for taking rendering timing for an image as a trigger, and the monitor signal. Thus, the start signal generated at the timing when the time corresponding to the integrated count value elapses is corrected to be close to a proper phase state.

The start signal with the phase corrected is outputted as a monitor signal through the dummy element again. The phase of the start signal is compared with the phase of the reference signal in the phase comparator. Since feedback of a correction state of the start signal is repeated in this way, the start signal is corrected to a proper phase. Thus, it is possible to obtain a proper image without a ghost.

It is possible to constitute the components such as the signal generating circuit, the reference signal generating circuit, the phase comparator, and the adder, which constitute the driving device for a liquid crystal panel, using digital circuits that are highly integrated easily such as a frequency divider, a phase detector, a shift register, and a counter.

Thus, it is possible to store the driving device for a liquid crystal panel in, for example, an integrated circuit formed of one chip.

Therefore, even if a characteristic of the internal circuit of the liquid crystal panel changes because of influences of a temperature change and aged deterioration, it is possible to obtain, with a simple constitution, a clear image without a ghost.

It is preferable that the phase comparator outputs, as the phase comparison information, data for not changing the integrated count value when a phase of the monitor signal coincides with a phase of the reference signal, outputs, as the phase comparison information, data for changing the integrated value by one in a direction for delaying a phase when a phase of the monitor signal is in advance of the phase of the reference signal, and outputs, as the phase comparison information, data for changing the integrated count value by one in a direction for advancing a phase when a phase of the monitor signal is delayed behind the reference signal. It is preferable that the adder supplies a value calculated by adding an integrated value of a value indicated by data serving as the phase comparison information to the initial count value to the counter as the integrated count value.

According to the constitution, the phase comparator outputs, as the phase comparison information, data for not changing the integrated count value when a phase of the monitor signal coincides with a phase of the reference signal, outputs, as the phase comparison information, data for changing the integrated value by one in a direction for delaying a phase when a phase of the monitor signal is in advance of the phase of the reference signal, and outputs, as the phase comparison information, data for changing the integrated count value by one in a direction for advancing a phase when a phase of the monitor signal is delayed behind the reference signal. The adder supplies a value calculated by adding an integrated value of a value indicated by data serving as the phase comparison information to the initial count value to the counter as the integrated count value. Thus, in order to continue phase correction according to the last integrated count value when the start signal is in a proper phase state judging from the phase comparison result of the monitor signal and bring a phase state of the start signal into the proper phase state when a phase of the start signal shifts from a phase of the monitor signal, the driving device for a liquid crystal panel performs phase correction corresponding to a count time for each count when feedback is performed once.

The phase comparator only has to be capable of outputting three forms of data, that is, the data for maintaining the integrated count value as the phase comparison information, the data equivalent to one count for delaying the integrated count value, and the data equivalent to one count for advancing the integrated count value. Thus, the phase comparator only has to have a simple constitution including a 2-bit data output function. Moreover, it is possible to constitute the adder using a simple integration register capable of adding 2-bit data to the initial count value. Therefore, it is possible to provide the driving device for a liquid crystal panel with a simple constitution.

It is preferable that the driving device for a liquid crystal panel includes a multiplier that generates a predetermined multiplied clock by multiplying a reference clock for synchronizing the plural timing signals including the start signal. It is preferable that the reference signal generating circuit generates a reference signal in synchronization with the multiplied clock and the counter performs count according to the multiplied clock.

According to the constitution, since the reference signal generating circuit generates a reference signal in synchronization with the multiplied clock, the driving device for a liquid crystal panel can precisely set a phase of the reference signal.

The counter performs count according to the multiplied clock. Thus, the driving device for a liquid crystal panel can precisely perform, using the multiplied clock, phase correction in a short time that cannot be adjusted with a period of the reference clock because the period is too long.

Thus, it is possible to adjust the plural timing signals including the start signal to a more appropriate phase state.

Therefore, the driving device for a liquid crystal panel can obtain a clear image without a ghost even if a characteristic of the internal circuit of the liquid crystal panel changes because of influences of a temperature change and aged deterioration.

It is preferable that the initial count value of the counter is set to a count value within a range of about 20% to 80% of a total number of counts of the counter.

According to the constitution, since the initial count value of the counter is set to a count value within a range of about 20% to 80% of a total number of counts of the counter, there are fixed margins of count values on both a plus side and a minus side of the initial count value. Thus, when a phase of the start signal shifts judging from the phase comparison result of the monitor signal, it is possible to adjust the phase with a fixed width with respect to both directions of phase advance and phase delay.

Therefore, the driving device for a liquid crystal panel can correct phases of the plural timing signals including the start signal until the phases become appropriate in the both direction of phase advance and phase delay.

It is preferable that the signal generating circuit provides a predetermined time with timing identical with the start point of the reference signal as a start point before the counter starts count corresponding to the integrated count value, causes the counter to perform count corresponding to the integrated count value after the predetermined time elapses, and generates the start signal with timing when the count ends as a start point.

According to the constitution, since the signal generating circuit provides a predetermined time with timing identical with the start point of the reference signal as a start point before the counter starts count corresponding to the integrated count value, causes the counter to perform count corresponding to the integrated count value after the predetermined time elapses, and generates the start signal with timing when the count ends as a start point. Thus, it is unnecessary to cover, with a count time of the counter, entire time until the timing when the start signal is generated. Thus, it is possible to reduce the total number of counts of the counter. The counter may be small.

Therefore, it is possible to provide the driving device for a liquid crystal panel with a simple constitution.

It is preferable that a predetermined time for generating the reference signal is set to time during which, when the start signal generated with the horizontal synchronizing signal as a trigger and with timing based on the initial count value as a start point after the predetermined time elapses is inputted to the liquid crystal panel having a standard transmission characteristic, a phase of the monitor signal outputted from the liquid crystal panel substantially coincides with a phase of the reference signal.

According to the constitution, the predetermined time is set to time during which, when the start signal generated with the horizontal synchronizing signal as a trigger and with timing based on the initial count value as a start point after the predetermined time elapses is inputted to the liquid crystal panel having a standard transmission characteristic, a phase of the monitor signal outputted from the liquid crystal panel substantially coincides with a phase of the reference signal. Thus, the driving device for a liquid crystal panel can adjust phases of the timing signals to an appropriate state even if the driving device has a simple constitution including a small counter.

According to another aspect of the invention, there is provided an image display apparatus including: a driving device for a liquid crystal panel described above; and a liquid crystal panel.

According to the constitution, the image display apparatus includes the driving device for a liquid crystal panel according to an aspect of the invention and the liquid crystal panel. Thus, it is possible to obtain a clear image without a ghost even if a characteristic of the internal circuit of the liquid crystal panel changes because of influences of a temperature change and aged deterioration.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of the invention will be hereinafter explained in detail with reference to the accompanying drawings.

Schematic Constitution of an Image Display Apparatus

Figure 1:
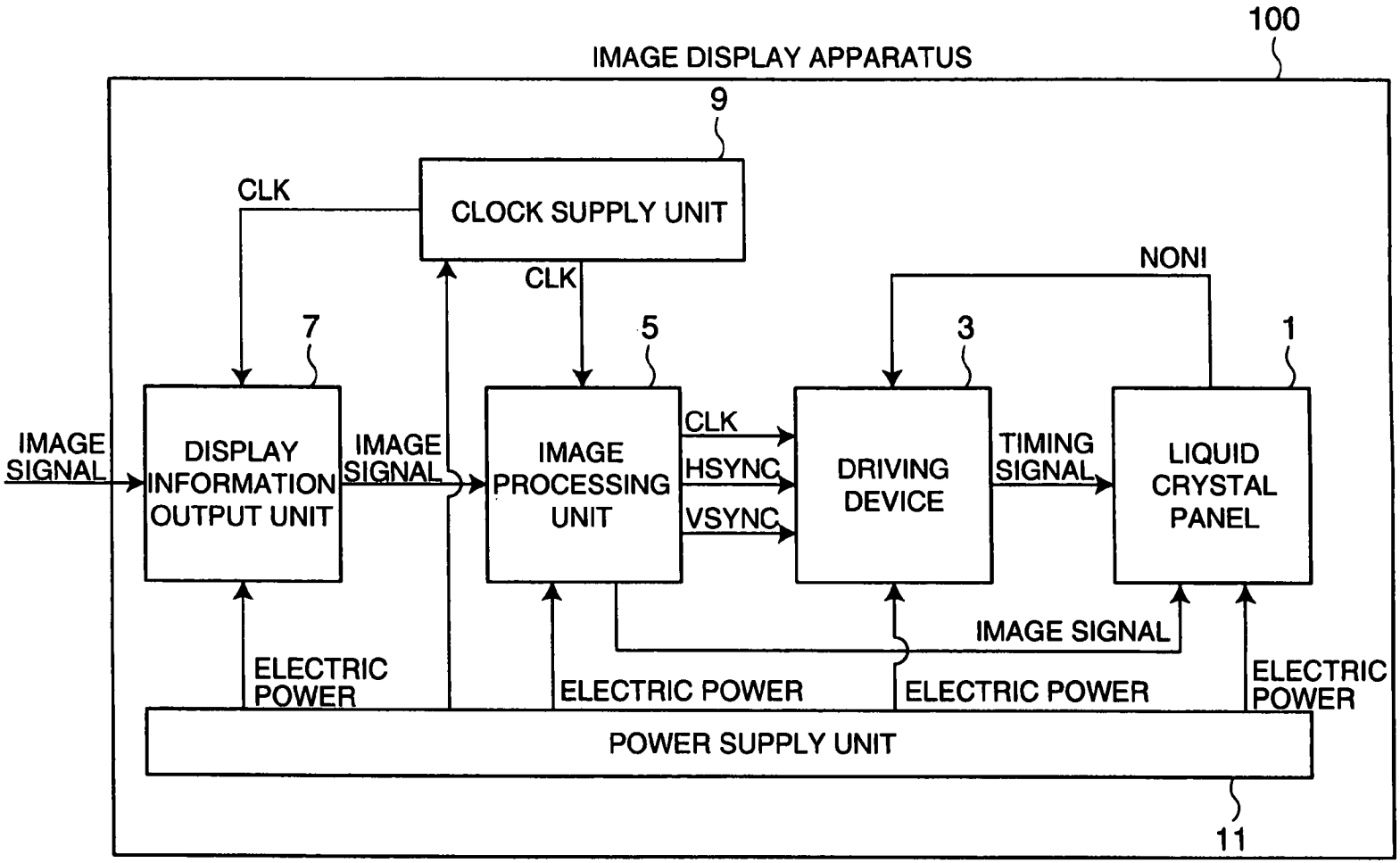
FIG. 1 is a schematic diagram of an image display apparatus according to an embodiment of the invention.

FIG. 1 is a schematic diagram of an image display apparatus according to the embodiment. A schematic constitution of an image display apparatus 100 will be explained.

The image display apparatus 100 includes a display information output unit 7, a clock supply unit 9, an image processing unit 5, a driving device 3 serving as a driving device for a liquid crystal panel, a liquid crystal panel 1, and a power supply unit 11.

An image signal is inputted to the display information output unit 7 from the outside. The display information output unit 7 converts the image signal into an image signal of a predetermined format based on a clock signal from the clock supply unit 9 and outputs the image signal to the image processing unit 5.

The clock supply unit 9 is an oscillating circuit including an oscillator such as a crystal oscillator. The clock supply unit 9 supplies a reference clock CLK serving as a reference clock signal to the respective units of the image display apparatus 100.

The image processing unit 5 subjects an image represented by an inputted image signal to image processing such as scaling processing for adjusting the image to resolution of the liquid crystal panel 1 by enlarging or reducing the image and outputs the image to the liquid crystal panel 1. In addition, the image processing unit 5 supplies the reference clock CLK, a horizontal synchronizing signal HSYNC, and a vertical synchronizing signal VSYNC to the driving device 3.

The driving device 3 generates plural timing signals, which determine timing for driving the liquid crystal panel 1, on the basis of the reference clock CLK, the horizontal synchronizing signal HSYNC, and the vertical synchronizing signal VSYNC supplied from the image processing unit 5 and outputs the plural timing signals to the liquid crystal panel 1.

The liquid crystal panel 1 is driven on the basis of the timing signals supplied from the driving device 3. The liquid crystal panel 1 displays the image signal inputted by the image processing unit 5 as an image and outputs a monitor signal MONI to the driving device 3.

The power supply unit 11 supplies electric power to the respective units described above.

Schematic Constitutions of the Driving Device and the Liquid Crystal Panel

Figure 2:
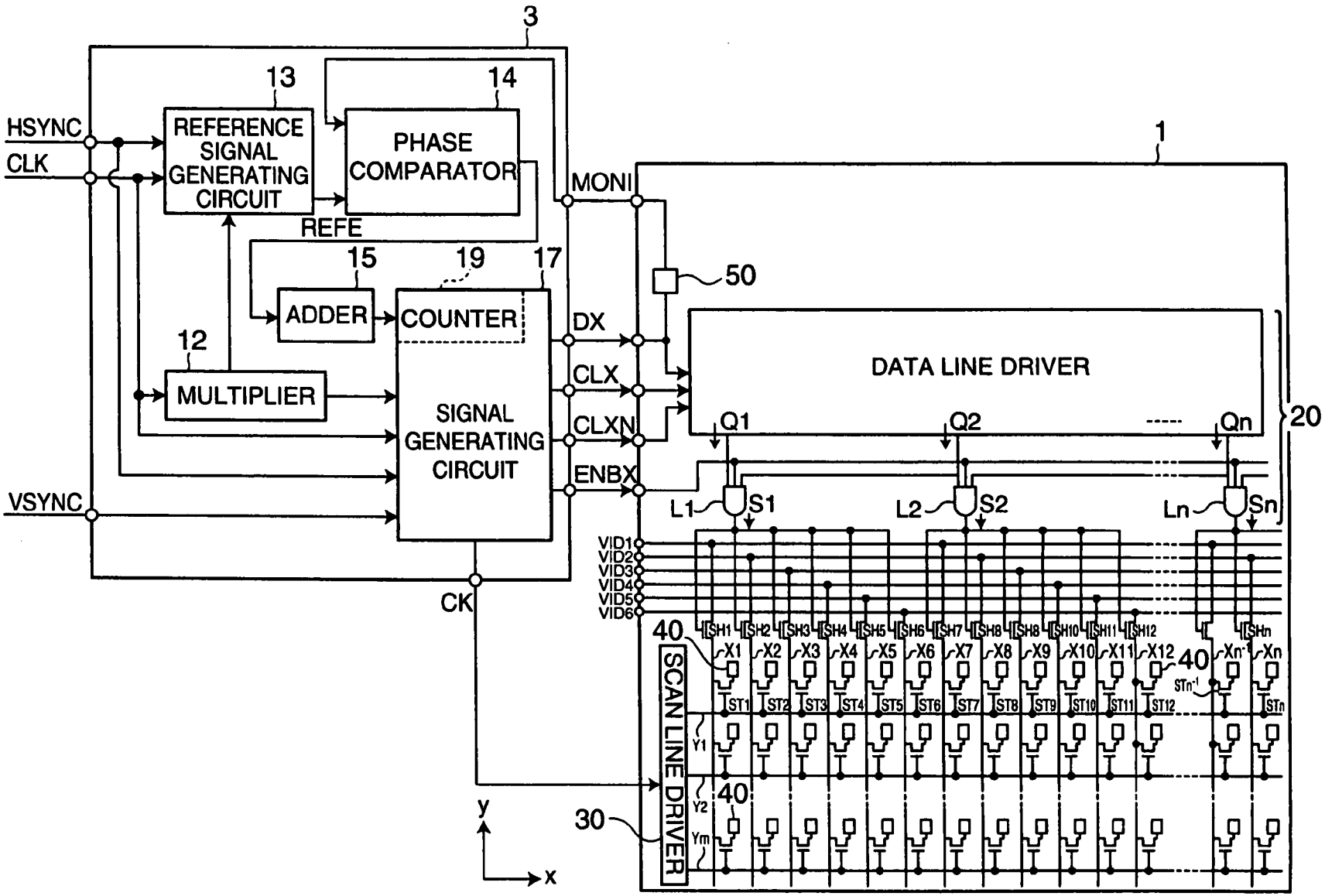
FIG. 2 is a schematic diagram of a driving device and a liquid crystal panel.

FIG. 2 is a schematic diagram of a driving device and a liquid crystal panel.

Schematic constitutions of the driving device 3 and the liquid crystal panel 1 in the image display apparatus 100 will be explained with reference to FIG. 2.

The driving device 3 includes a multiplier 12, a reference signal generating circuit 13, a phase comparator 14, an adder 15, and a signal generating circuit 17.

The multiplier 12 is, for example, a Phase Locked Loop (PLL) and generates a multiplied clock obtained by multiplying the reference clock CLK. For example, when the reference clock CLK is 75 MHz, the multiplier 12 generates a multiplied clock of 300 MHz obtained by multiplying the reference clock CLK by four. The multiplier 12 supplies a quadrupled clock to the reference signal generating circuit 13, the signal generating circuit 17, and the like.

The reference clock CLK, the quadrupled clock, the horizontal synchronizing signal HSYNC, and the like are supplied to the reference signal generating circuit 13. The reference signal generating circuit 13 generates a reference signal REFE based on the quadrupled clock with the horizontal synchronizing signal HSYNC as a trigger and with timing when a predetermined time elapses as a start point.

The phase comparator 14 is, for example, a phase detector. The phase comparator 14 compares phases of the reference signal REFE and the monitor signal MONI and outputs phase comparison information described below.

When the phase of the monitor signal MONI coincides with the phase of the reference signal REFE, the phase comparator 14 outputs data "00" indicating "±0" not to "change an integrated count value". When the phase of the monitor signal MONI is in advance of the phase of the reference signal REFE, the phase comparator 14 outputs data "01" indicating "+1" to "change an integrated count value by one in a direction for delaying a phase". When the phase of the monitor signal MONI is delayed behind the phase of the reference signal REFE, the phase comparator 14 outputs data "11" indicating "−1" to "change an integrated count value by one in a direction for advancing a phase".

The adder 15 is, for example, an integration register. The adder 15 outputs an integrated count value for adjusting timing for generating a start signal DX from an initial count value "Defv" set in advance and the phase comparison information from the phase comparator 14. The initial count value "Defv" is set to a count value within a range of about 20% to 80% of the total number of counts of a counter 19. For example, when the counter 19 is an 8-bit counter, a count value of "127 counts" is set as the initial count value.

The adder 15 supplies a value, which is obtained by adding an integrated value of a value indicated by data serving as the phase comparison information to the initial count value, to the counter 19 as the integrated count value.

A relation of plus and minus of the data serving as the phase comparison information may be opposite depending on a constitution of a counter described later.

The signal generating circuit 17 includes the counter 19. The counter 19 may be formed as, for example, an independent section.

The counter 19 is, for example, an 8-bit counter. The counter 19 counts the quadrupled clock supplied from the multiplier 12 as a clock. The counter 19 may count the reference clock CLK as a clock.

The signal generating circuit 17 generates plural timing signals including the start signal DX and supplies the timing signals to the liquid crystal panel 1.

The start signal DX is generated with the horizontal synchronizing signal HSYNC as a trigger and with timing when count corresponding to the integrated count value is finished by the counter 19 after the predetermined time elapses as a start point.

The signal generating circuit 17 generates, with the start signal DX as a reference, plural timing signals CLXN, ENBX, and the like in phase with the start signal DX and supplies the timing signals to the liquid crystal panel 1 together with the reference clock CLK.

Subsequently, a schematic constitution of the liquid crystal panel 1 will be explained.

The liquid crystal panel 1 includes a data line driver 20, a scan line driver 30, scan lines Y1 to Ym, data lines X1 to Xn, sampling circuits SH1 to SHn, pixel electrodes 40, pixel TFT circuits ST1 to STn, and a dummy element 50.

The data line driver 20 includes selection circuits L1 to Ln serving as three-input AND circuits. The data line driver 20 generates output signals Q1 to Qn on the basis of three timing signals, that is, the start signal DX, the reference clock CLX, and the inverted clock signal CLXN supplied from the signal generating circuit 17.

The selection circuit L1 of the data line driver 20 generates a sampling signal S1 according to logical multiplication from three signals, that is, the signals Q1 and Q2 generated and the enable signal ENBX supplied from the signal generating circuit 17. Similarly, the selection circuits L2 to Ln generate sampling signals S2 to Sn according to logical multiplication from three signals, that is, the enable signal ENBX and two signals "Q2, Q3", "Q3, Q4", . . . , or "Qn−1, Qn" adjacent to each other.

The scan line driver 30 sequentially selects the respective scan lines Y1 to Ym and outputs scan signals to the scan lines Y1 to Ym at timing based on a clock CK supplied from the signal generating circuit 17.

Both the data line driver 20 and the scan line driver 30 are formed by a circuit such as a shift register.

The scan lines Y1 to Ym are plural wirings made of a transparent electrode of an Indium Tin Oxide (ITO) film or the like and extend in an x direction, respectively.

The data lines X1 to Xn are plural wirings made of a transparent electrode of the ITO film or the like and extend along a y direction, respectively.

The sampling circuits SH1 to SHn are switching elements formed of TFT and provided in association with the respective data lines X1 to Xn.

The pixel electrodes 40 are provided at respective intersections of the scan lines Y1 to Ym and the data lines X1 to Xn.

The pixel TFT circuits ST1 to STn are provided in association with the respective pixel electrodes 40. The respective data lines X1 to Xn, the respective pixel electrodes 40, and the respective scan lines Y1 to Ym are connected to source electrodes, drain electrodes, and gate electrodes of the pixel TFT circuits ST1 to STn, respectively. The pixel TFT circuits ST1 to STn control a state of conduction and a state of non-conduction to the respective pixel electrodes 40 corresponding thereto.

The respective components of the liquid crystal panel 1 are provided on a glass substrate (not shown) of the liquid crystal panel 1. Liquid crystal cells corresponding to the respective pixel electrodes 40 are filled between two opposed glass substrates.

The dummy element 50 is provided on a glass substrate identical with the glass substrate on which the respective components of the liquid crystal panel 1 such as the sampling circuits SH1 to SHn are provided.

The start signal DX supplied from the signal generating circuit 17 is branched to the dummy element 50. The start signal DX branched changes to the monitor signal MONI through the dummy element 50 to be outputted to the phase comparator 14 of the driving device 3.

The dummy element 50 is formed on a glass substrate identical with the glass substrate on which the data line driver 20, the sampling circuits SH1 to SHn, and the like are formed in the liquid crystal panel 1.

Therefore, since the dummy element 50 includes parasitic capacitance, wiring resistance, and the like same as those of the data line driver 20, the sampling circuits SH1 to SHn, and the like, the dummy element 50 has a transmission characteristic equivalent to a transmission characteristic of a signal of the circuits of TFT or the like and the transparent electrode constituting the sections.

Thus, when the liquid crystal panel 1 is used, if shift of a phase of a signal occurs in the data line driver 20, the sampling circuits SH1 to SHn, or the like because of a temperature change or aged deterioration, substantially the same phenomenon occurs in the dummy element 50.

The sampling circuits SH1 to SHn sample image signals VID1 to VID6 expanded into six phases in parallel supplied from the image processing unit 5 (FIG. 1) on the basis of sampling signals S1 to Sn supplied from the selection circuits L1 to Ln and outputs the image signals VID1 to VID6 to the respective data lines X1 to Xn corresponding thereto.

The sampling signal S1 outputted by one selection circuit L1 is inputted to continuous six sampling circuits SH1 to SH6 in parallel. This is for the purpose of outputting the image signals VID1 to VID6 to the continuous six data lines X1 to Xn at identical timing and in an identical period because the images signals VID1 to VID6 are expanded into six phases in parallel.

Operation in an Appropriate Phase State

Figure 3:
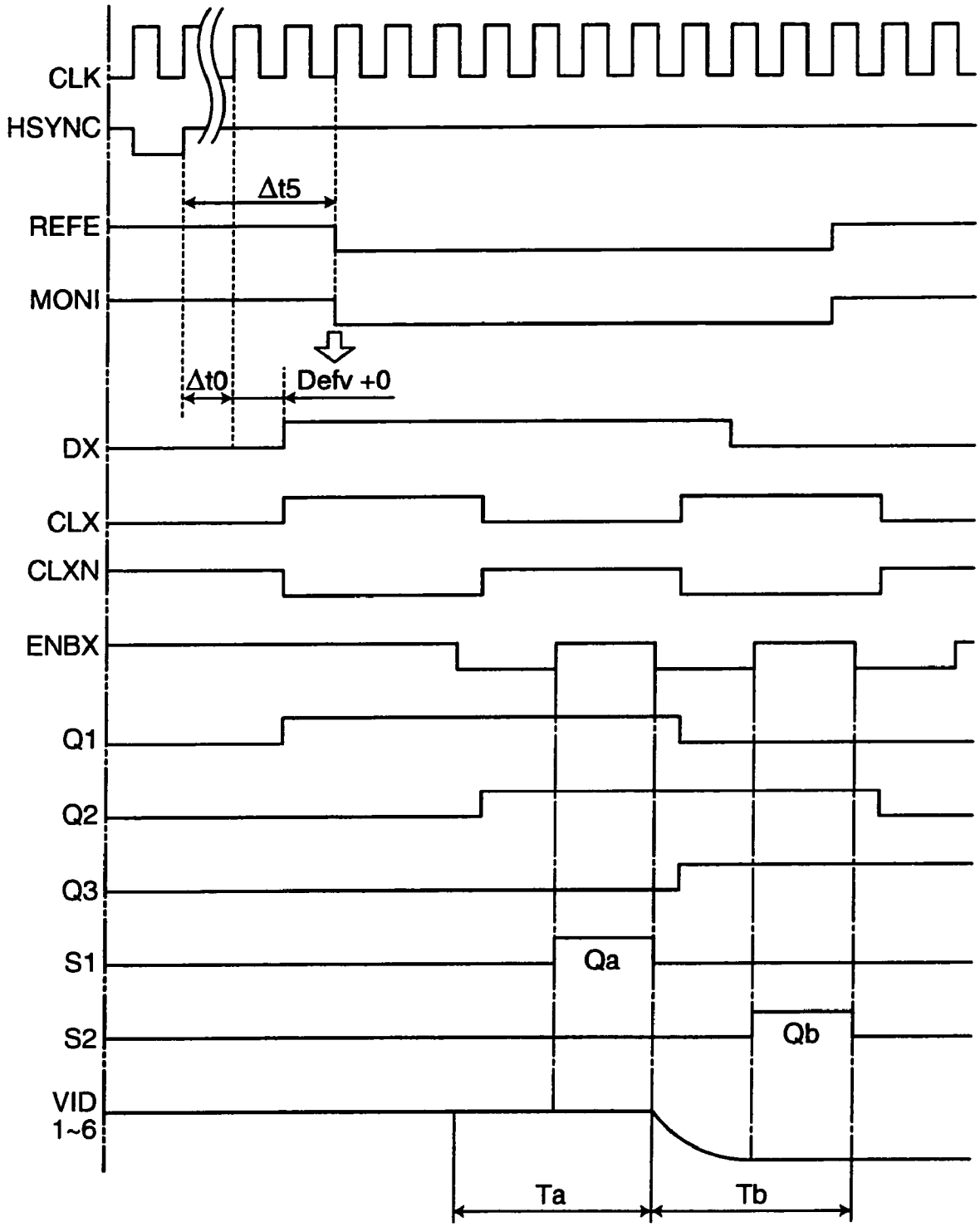
FIG. 3 is a timing chart of respective signals in an appropriate phase state.
Figure 6A:
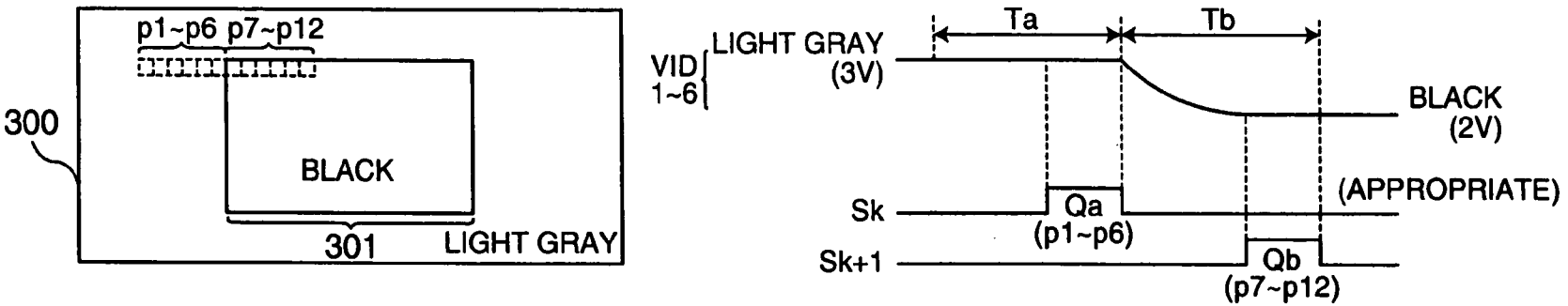
FIG. 6A is a diagram showing a displayed image and a signal state in the appropriate phase state.

FIG. 3 is a timing chart showing timing of respective signals in an appropriate state in which a ghost image is not caused. The appropriate state means an appropriate state in which, as shown in FIG. 6A, a period in which the sampling circuit driving signals S1 to Sn are at a high level and a period in which the image signals VID1 to VID6 reach a saturated level temporally coincide with each other and a ghost image is not caused.

An operation of the driving device 3 in the appropriate image state in which a ghost image is not caused in the image display apparatus 100 will be explained with reference to FIGS. 3 and 2.

Clocks in the driving device 3 include the quadrupled clock generated by the multiplier 12 other than the reference clock CLK. However, the quadrupled clock is not shown in FIG. 3 and is not shown in FIGS. 4 and 5 described later either.

The signal generating circuit 17 generates the start signal DX with timing when a predetermined time Δt0 elapses from a rising edge of the horizontal synchronizing signal HSYNC and the counter 19 ends count corresponding to an integrated count value as a start point and outputs the start signal DX to the liquid crystal panel 1.

The predetermined time Δt0 is time derived from timing of the image signals VID1 to VID6 and set in the signal generating circuit 17 in advance.

At the time when the driving device 3 is started, count of the counter 19 is started after the predetermined time Δt0 elapses. The start signal DX is generated with timing when count corresponding to the initial count value "Defv" by the counter 19 ends as a start point.

The reference signal generating circuit 13 generates the reference signal REFE on the basis of the quadrupled clock with the rising edge of the horizontal synchronizing signal HSYNC as a trigger and with timing when a predetermined time Δt5 elapses as a start point. The reference signal REFE may be generated with the reference clock CLK as a reference.

The predetermined time Δt5 is time derived from standard output timing of the start signal DX and a standard transmission characteristic of a signal of the liquid crystal panel 1 and set in the reference signal generating circuit 13 in advance.

Consequently, when the liquid crystal panel 1 has a standard delay characteristic of a signal, a phase of the monitor signal MONI substantially coincides with the reference signal REFE.

The start signal DX outputted from the signal generating circuit 17 to the liquid crystal panel 1 changes to the monitor signal MONI through the dummy element 50 of the liquid crystal panel 1 to be outputted to the phase comparator 14 of the driving device 3. Therefore, a phase of the monitor signal MONI is always later than the start signal DX because of time required for passing through the dummy element 50.

In FIG. 3, phases of the reference signal REFE and the monitor signal MONI coincide with each other.

Therefore, since the phase of the monitor signal MONI coincides with the phase of the reference signal REFE, the phase comparator 14 outputs data "00" indicating a "±0" value for not "changing an integrated count value" to the adder 15 as phase comparison information.

The adder 15 outputs an integrated count value "Defv+0" obtained by adding "±0" indicated by the data "00" to the initial count value "Defv" to the counter 19.

Consequently, as shown in the timing chart of the start signal DX in FIG. 3, since there is no shift between the phase of the reference signal REFE and the phase of the monitor signal MONI, the signal generating circuit 17 generates the start signal DX with timing when the predetermined time Δt0 elapses from the next rising edge of the horizontal synchronizing signal HSYNC. The counter 19 ends count corresponding to the integrated count value "Defv+0" (=Defv) as a start point.

Moreover, the signal generating circuit 17 generates the plural timing signals CLXN, ENBX, and the like with a rising edge of the start signal DX as a reference and supplies the timing signals to the liquid crystal panel 1.

The data line driver 20 generates the output signals Q1 to Qn on the basis of three timing signals, that is, the start signal DX, the reference clock CLX, and the inversed clock CLXN supplied from the signal generating circuit 17. In FIG. 3, the signals Q1 to Q3 are shown.

The selection circuits L1 to Ln of the data line driver 20 generate, according to logical multiplication, the sampling signals S1 to Sn from three signals, that is, the generated adjacent "Qn−1, Qn" signals and the enable signal ENBX supplied from the signal generating circuit 17. In FIG. 3, the sampling signals S1 to S2 are shown.

The sampling circuits SH1 to SHn sample the image signals VID1 to VID6 expanded into six phases in parallel supplied from the image processing unit 5 on the basis of the sampling signals S1 to Sn supplied from the selection circuits L1 to Ln and output the image signals VID1 to VID6 to the respective data lines X1 to Xn corresponding thereto.

The image signals VID1 to VID6 are integrated by an internal circuit of the liquid crystal panel 1, whereby an edge of a waveform thereof is blunted. Therefore, in a period in which the image signals VID1 to VID6 reach a saturated level (e.g., a period as late as possible in the image signal periods Ta and Tb), the image signals ViD1 to VID6 need to be outputted to the pixel TFT circuits ST1 to STn.

A phase relation between the sampling signals S1 and S2 and the image signals VId1 to VID6 in FIG. 3 is the same as the relation between the sampling signals Sk and Sk+1 and the image signals VID1 to VID6 in FIG. 6A.

The sampling signals Sk and Sk+1 are read as the sampling signals S1 to S2 and explained below with reference to FIG. 6A.

The image signals VID1 to VID6 are represented by, for example, a waveform having a voltage level (3V) indicating light gray and a voltage level (2V) indicating black.

A period Qa in which a sampling signal S1 (Sk) is at a high level (a high-level period Qa of a sampling signal S1 (Sk)) determines timing for inputting the image signals VID1 to VID6 to pixel TFT circuits corresponding to pixels P1 to P6 on a left side of a window pattern 301.

The high-level period Qa temporally coincides with a period in which the image signals VID1 to VID6 reach a saturated level (3V) of light gray in the image signal period Ta. The image signals VID1 to VID6 representing light gray are inputted to respective pixel electrodes of the pixels P1 to P6.

A period Qb in which a sampling signal S2 (Sk+1) is at a high level (a high-level period Qb of a sampling signal S2 (Sk+1)) determines timing for inputting the image signals VID1 to VID6 to pixel TFT circuits corresponding to pixels P7 to P12 in the window pattern 301.

The high-level period Qb temporally coincides with a period in which the image signals VID1 to VID6 reach a saturated level (2V) of black in the image signal period Tb. The image signals VID1 to VID6 representing black are inputted to respective pixel electrodes of the pixels P7 to P12.

Thus, in a state shown in FIG. 6A, a ghost is not caused at the left end of the window pattern 201.

A line of the pixels P1 to P12 has been explained as an example. However, since phase states of the sampling signals are kept in an appropriate state by the driving device 3, images are displayed at the same timing not only on the line but also on all lines on the liquid crystal panel 1. Thus, in an image 300 represented by an image signal VID, the black substantially square window pattern 301 with a light gray background is displayed as a clear image without a ghost image.

Operation in an Advance State

Figure 4:
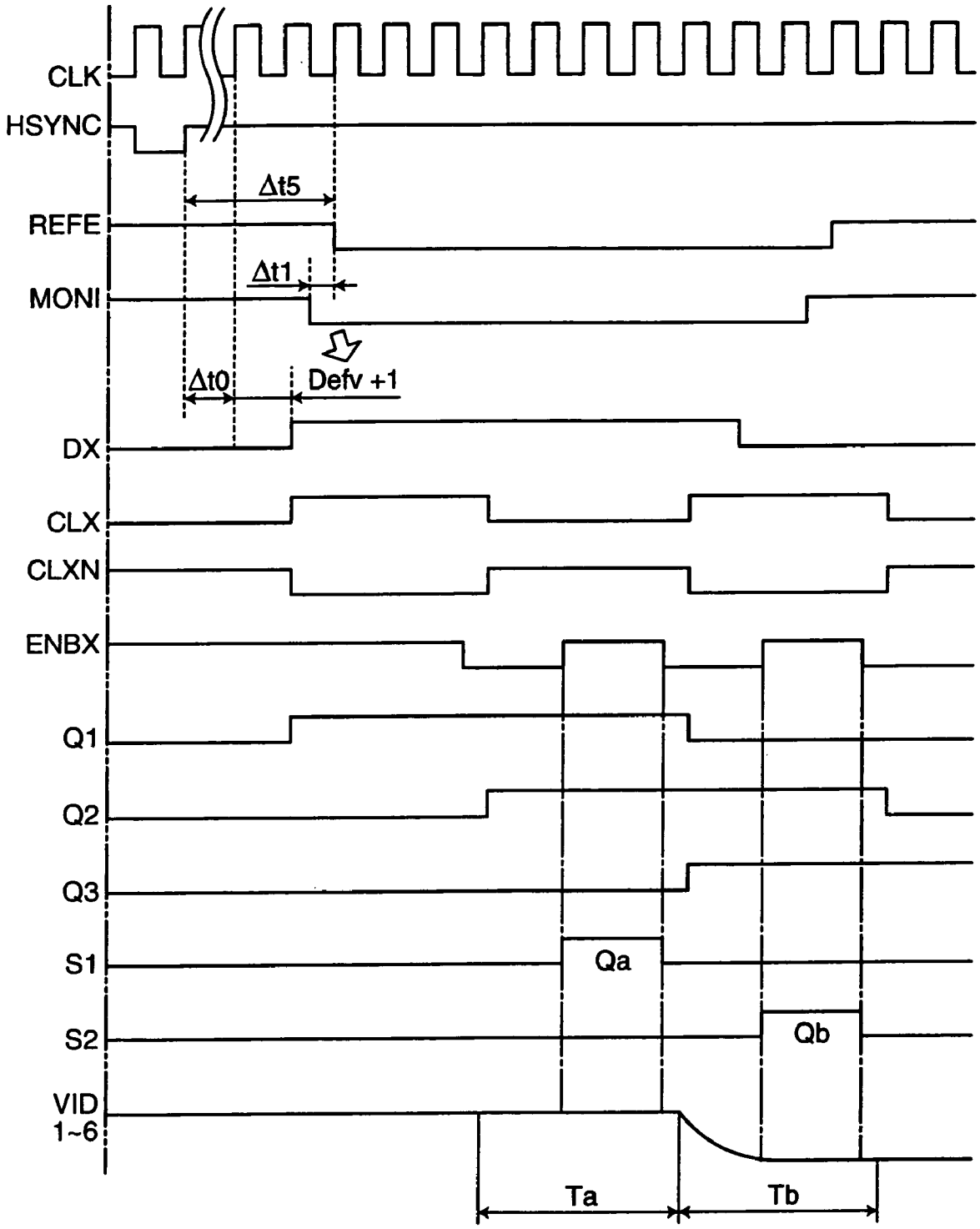
FIG. 4 is a timing chart of respective signals in a shape advance state.

FIG. 4 is a timing chart showing timing of respective signals at the time when a ghost image is caused because sampling signals are temporally ahead of image signals.

Figure 6B:
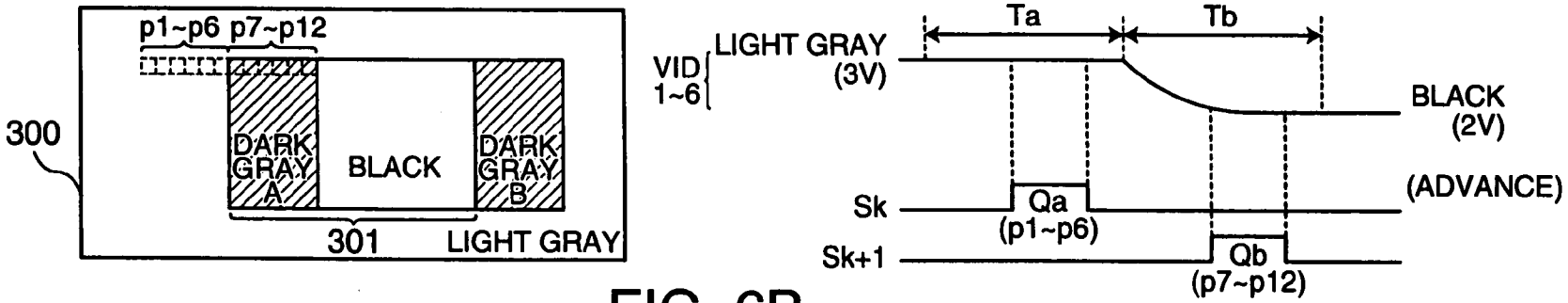
FIG. 6B is a diagram showing a displayed image and a signal state in the phase advance state.

An advance state is a state in which, as shown in FIG. 6B, a ghost image is caused because a period in which the sampling circuit driving signals S1 to Sn are at a high level is temporally ahead of a period in which the image signals VID1 to VID6 reach a saturated level.

An operation of the driving device 3 of the image display apparatus 100 in the advance state in which a ghost image is caused will be explained with reference to FIGS. 4 and 2. Explanations of contents repeating the explanation concerning the operation in the appropriate phase state are omitted.

The start signal DX outputted from the signal generating circuit 17 to the liquid crystal panel 1 changes to the monitor signal MONI through the dummy element 50 of the liquid crystal panel 1 to be outputted to the phase comparator 14 of the driving device 3.

In FIG. 4, a phase of the monitor signal MONI outputted from the liquid crystal panel 1 is in advance of a phase of the reference signal REFE by Δt1.

A start point of the start signal DX only has to be delayed in order to correct the advance Δt1 of the phase of the monitor signal MONI.

Thus, the phase comparator 14 outputs data "01" indicating a "+1" value for "changing an integrated count value by one in a direction for delaying a phase" of the start signal DX to the adder 15.

The adder 15 outputs an integrated count value "Defv+1" obtained by adding the "+1" value indicated by the data "01", to the initial count value "Defv" to the counter 19.

Consequently, as shown in the timing chart of the start signal DX shown in FIG. 4, the signal generating circuit 17 generates the start signal DX with timing when the predetermined time Δt0 elapses from the next rising edge of the horizontal synchronizing signal HSYNC and the counter 19 ends count corresponding to the integrated count value "Defv+1" as a start point.

Moreover, the signal generating circuit 17 generates the plural timing signals CLXN, ENBX, and the like with a rising edge of the start signal DX as a reference and supplies the timing signals to the liquid crystal panel 1.

The data line driver 20 generates the output signals Q1 to Qn on the basis of three timing signals, that is, the start signal DX, the reference clock CLX, and the inversed clock CLXN supplied from the signal generating circuit 17. In FIG. 4, the signals Q1 to Q3 are shown.

The selection circuits L1 to Ln of the data line driver 20 generate the sampling signals S1 to Sn according to logical multiplication from three signals, that is, the generated adjacent "Qn−1, Qn" signals and the enable signal ENBX supplied from the signal generating circuit 17. In FIG. 4, the sampling signals S1 to S2 are shown.

The sampling circuits SH1 to SHn sample the image signals VID1 to VID6 expanded into six phases in parallel supplied from the image processing unit 5 on the basis of the sampling signals S1 to Sn supplied from the selection circuits L1 to Ln and output the image signals VID1 to VID6 to the respective data lines X1 to Xn corresponding thereto.

A phase relation between the sampling signals S1 and S2 and the image signals VId1 to VID6 in FIG. 4 is the same as the relation between the sampling signals Sk and Sk+1 and the image signals VID1 to VID6 in FIG. 6B.

The sampling signals Sk and Sk+1 are read as the sampling signals S1 to S2 and explained below with reference to FIG. 6B.

In FIG. 6B, the sampling signals S1 (Sk) and S2 (Sk+1) temporally advance because of influences of a temperature change and aged deterioration of the liquid crystal panel 1. Thus, a part of the high-level period Qb shifts from the saturated level (2V) of black in the image signal period Tb in the image signals VID1 to VID6 and temporally overlaps a voltage level close to light gray.

Therefore, a part of the image signals VID1 to VID6 of the voltage level close to gray are inputted to the respective pixel electrodes of the pixels P7 to P12 other than the image signals VID1 to VID6 that reach the saturated level (2V) of black. As a result, the image signals are mixed to cause a ghost of dark gray A on an inner side of a left side of the window pattern 301.

At this point, the same phenomenon occurs in continuous six pixels on an outer side of a right side of the window pattern 301. A part of the image signals VID1 to VID6 of the voltage level close to light gray are inputted to respective pixel electrodes on the right side other than the image signals VID1 to VID6 that reach the saturated level (2V) of black. As a result, the image signals are mixed to cause a ghost of dark gray B on the outer side of the right side of the window pattern 301 as well.

When the advance state of the sampling signals S1 (Sk) and S2 (Sk+1) on the lines of the pixels P6 to P12 continues for the number of scan lines equivalent to one screen, as shown in FIG. 6B, the ghost is caused in the same manner on all the lines on the liquid crystal panel 1. However, according to phase correction by the driving device 3, a ghost is not caused on the entire screen. A reason for this is described below.

Referring back to FIG. 4, a ghost image is also caused by a timing signal using the start signal DX generated in a state in which phase correction is performed according to the integrated count value "Defv+1" as a trigger. This indicates that a correction amount is insufficient in "+1" count.

As described before, an image represented by the timing signal including the start signal DX according to a correction amount of the integrated count value "Defv+1" indicates the advance state. Thus, a phase of the monitor signal MONI, which is the start signal DX returning through the dummy element 50, is in advance of a phase of the reference signal REFE.

Thus, the adder 15 outputs an integrated count value "Defv+2" obtained by adding a "+1" value indicated by data "01" to the initial count value "Defv+1" to the counter 19.

The signal generating circuit 17 generates the start signal DX with timing when the predetermined time Δt0 elapses from the next rising edge of the horizontal synchronizing signal HSYNC and the counter 19 ends count corresponding to the integrated count value "Defv+2" as a start point.

In this way, when a phase shifts judging from a phase comparison result of the monitor signal MONI, the driving device 3 finally adjusts the timing signal to the phase of the appropriate state shown in FIG. 3 by performing phase correction equivalent to a count time for each count per one scan line in order to bring the phase into the appropriate phase state.

For example, when the image signal VID is an image signal with resolution VGA (640×480 dots), horizontal synchronizing signals equivalent to 480 lines of resolution in the vertical direction per one screen are outputted. The driving device 3 performs phase correction once for each scan line.

Thus, for example, even if there is a shift amount of a phase of a sampling signal for time equivalent to 80 counts, the phase changes to the appropriate state at a stage of phase correction for 80/480 scan lines without waiting for one screen to be depicted.

Operation in a Delay State

Figure 5:
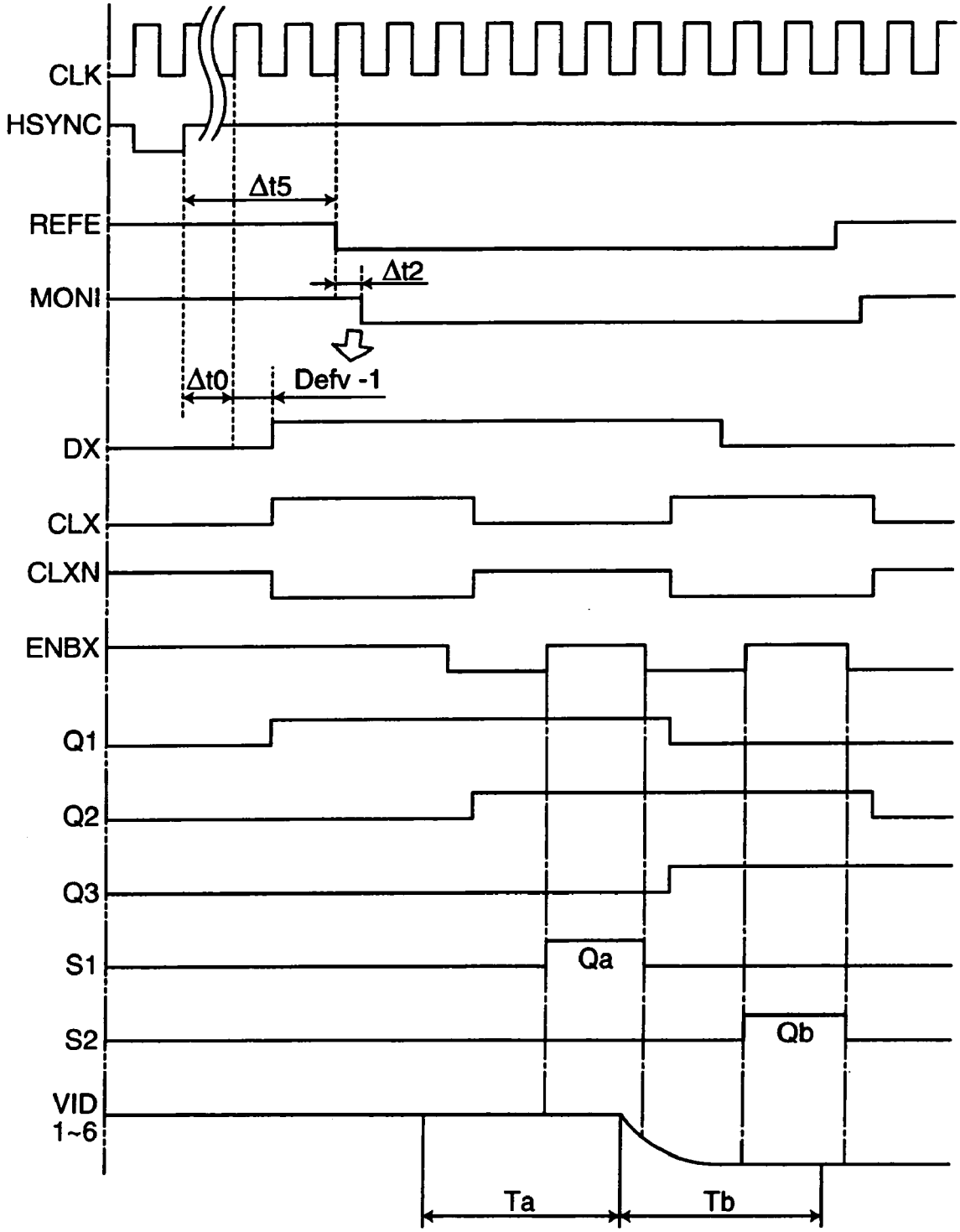
FIG. 5 is a timing chart of respective signals in a phase delay state.

FIG. 5 is a timing chart showing timing of respective signals at the time when a ghost image is caused because sampling signals are temporally behind images signals.

Figure 6C:
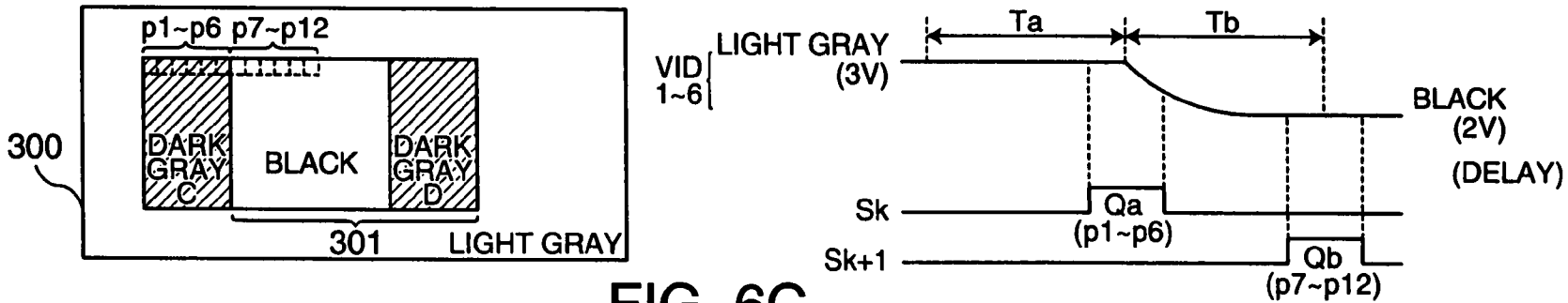
FIG. 6C is a diagram showing a displayed image and a signal state in the phase delay state.
Figure 7:
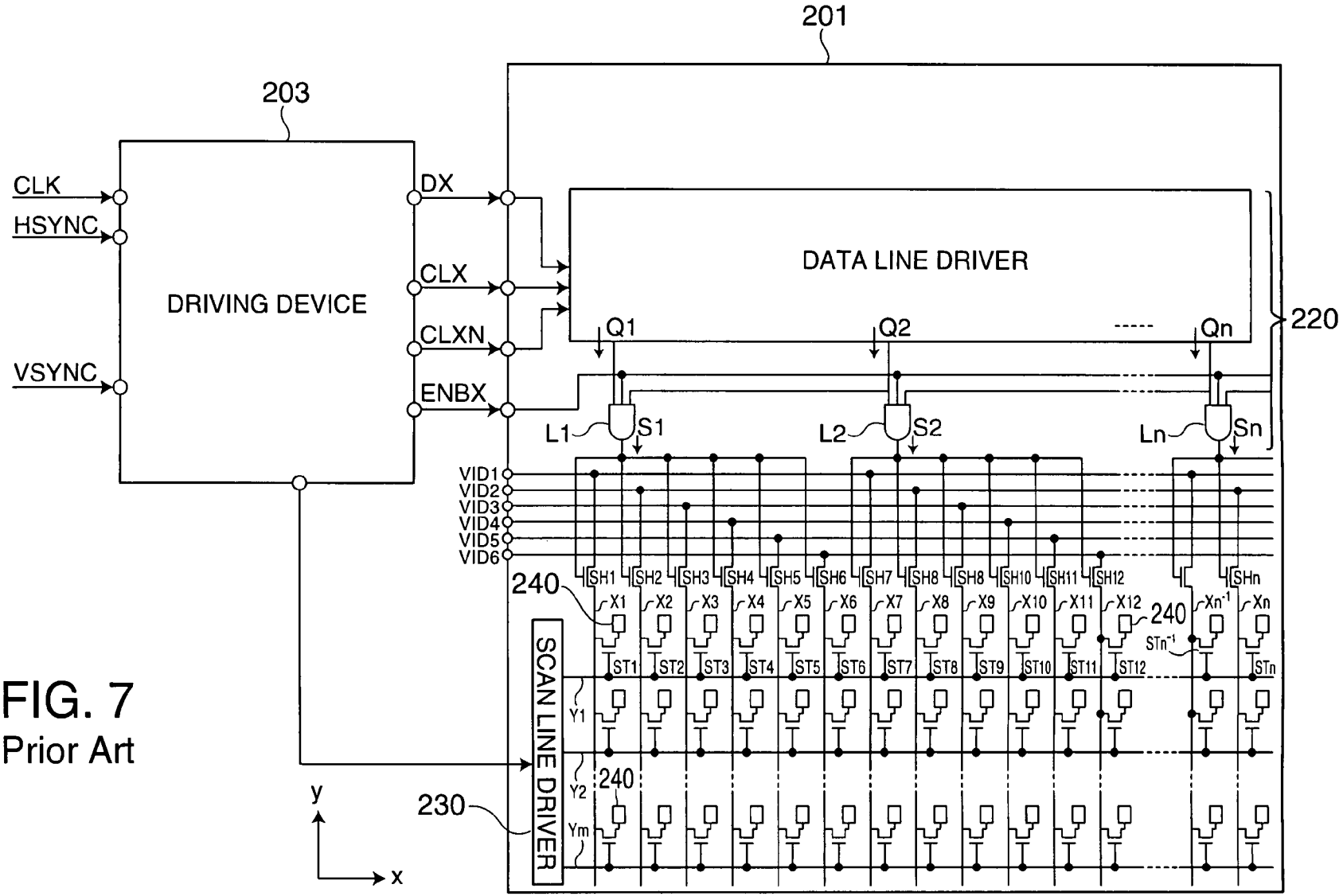
FIG. 7 Prior Art
FIG. 7 is a schematic diagram of a driving device and a liquid crystal panel in the past.

A delay state is a state in which, as shown in FIG. 6C, a ghost image is caused because a period in which the sampling circuit driving signals S1 to Sn are at a high level is temporally delayed behind a period in which the image signals VID1 to VID6 reach a saturated level.

An operation of the driving device 3 of the image display apparatus 100 in the delay state in which a ghost image is caused will be explained with reference to FIGS. 5 and 2. Explanations of contents repeating the explanation concerning the operation in an appropriate phase state and the operation in the advance state are omitted.

The start signal DX outputted from the signal generating circuit 17 to the liquid crystal panel 1 changes to the monitor signal MONI through the dummy element 50 of the liquid crystal panel 1 to be outputted to the phase comparator 14 of the driving device 3.

In FIG. 5, a phase of the monitor signal MONI outputted from the liquid crystal panel 1 is delayed behind a phase of the reference signal REFE by Δt2.

A start point of the start signal DX only has to be advanced in order to correct the delay Δt2 of the phase of the monitor signal MONI.

Thus, the phase comparator 14 outputs data "11" indicating a "−1" value for "changing an integrated count value by one in a direction for advancing a phase" of the start signal DX to the adder 15.

The adder 15 outputs an integrated count value "Defv−1" obtained by adding the "−1" value indicated by the data "11" to the initial count value "Defv" to the counter 19.

Consequently, as shown in the timing chart of the start signal DX shown in FIG. 5, the signal generating circuit 17 generates the start signal DX with timing when the predetermined time Δt0 elapses from the next rising edge of the horizontal synchronizing signal HSYNC and the counter 19 ends count corresponding to the integrated count value "Defv−1" as a start point.

Moreover, the signal generating circuit 17 generates the plural timing signals CLXN, ENBX, and the like with a rising edge of the start signal DX as a reference and supplies the timing signals to the liquid crystal panel 1.

The data line driver 20 generates the output signals Q1 to Qn on the basis of three timing signals, that is, the start signal DX, the reference clock CLX, and the inversed clock CLXN supplied from the signal generating circuit 17. In FIG. 5, the signals Q1 to Q3 are shown.

The selection circuits L1 to Ln of the data line driver 20 generate the sampling signals S1 to Sn according to logical multiplication from three signals, that is, the generated adjacent "Qn−1, Qn" signals and the enable signal ENBX supplied from the signal generating circuit 17. In FIG. 5, the sampling signals S1 to S2 are shown.

The sampling circuits SH1 to SHn sample the image signals VID1 to VID6 expanded into six phases in parallel supplied from the image processing unit 5 on the basis of the sampling signals S1 to Sn supplied from the selection circuits L1 to Ln and output the image signals VID1 to VID6 to the respective data lines X1 to Xn corresponding thereto.

A phase relation between the sampling signals S1 and S2 and the image signals VID1 to VID6 in FIG. 5 is the same as the relation between the sampling signals Sk and Sk+1 and the image signals VID1 to VID6 in FIG. 6C.

The sampling signals Sk and Sk+1 are read as the sampling signals S1 to S2 and explained below with reference to FIG. 6C.

In FIG. 6C, the sampling signals S1 (Sk) and S2 (Sk+1) are temporally delayed because of influences of a temperature change and aged deterioration of the liquid crystal panel 1. Thus, a part of the high-level period Qa shifts from the saturated level (3V) of light gray in the image signal period Ta in the image signals VID1 to VID6 and temporally overlaps a voltage level close to black.

Therefore, a part of the image signals VID1 to VID6 of the voltage level close to black are inputted to the respective pixel electrodes of the pixels P1 to P6 other than the image signals VID1 to VID6 that reach the saturated level (3V) of light gray. As a result, the image signals are mixed to cause a ghost of dark gray C on an outer side of the left side of the window pattern 301.

At this point, the same phenomenon occurs in continuous six pixels on the inner side of the right side of the window pattern 301. A part of the image signals VID1 to VID6 of the voltage level close to black are inputted to respective pixel electrodes on the right side other than the image signals VID1 to VID6 that reach the saturated level (3V) of light gray. As a result, the image signals are mixed to cause a ghost of dark gray D on the inner side of the left side of the window pattern 301.

When the delay state of the sampling signals S1 (Sk) and S2 (Sk+1) on the lines of the pixels P6 to P12 continues for the number of scan lines equivalent to one screen, as shown in FIG. 6C, the ghost is caused in the same manner on all the lines on the liquid crystal panel 1. However, according to phase correction by the driving device 3, a ghost is not caused on the entire screen. A reason for this is described below.

Referring back to FIG. 5, a ghost image is also caused by a timing signal that uses the start signal DX, which is generated in a state in which phase correction is performed according to the integrated count value "Defv−1", as a trigger. This indicates that a correction amount is insufficient in "−1" count.

As described before, an image represented by the timing signal including the start signal DX according to a correction amount of the integrated count value "Defv−1" indicates the delay state. Thus, a phase of the monitor signal MONI, which is the start signal DX returning through the dummy element 50, is delayed behind a phase of the reference signal REFE.

Thus, the adder 15 outputs an integrated count value "Defv−2" obtained by adding data "11" indicating a "−1", value to the integrated count value to the counter 19.

The signal generating circuit 17 generates the start signal DX with timing when the predetermined time Δt0 elapses from the next rising edge of the horizontal synchronizing signal HSYNC and the counter 19 ends count corresponding to the integrated count value "Defv−2" as a start point.

In this way, when a phase shifts judging from a phase comparison result of the monitor signal MONI, the driving device 3 finally adjusts the phase of the timing signal to the phase of the appropriate state shown in FIG. 3 by performing phase correction equivalent to a count time for each count per one scan line in order to bring the phase into an appropriate phase state.

For example, when the image signal VID is an image signal of 480 p, horizontal synchronizing signals equivalent to 480 scan lines per one screen are outputted. The driving device 3 performs phase correction once for each scan line.

Thus, for example, even if there is a shift amount of a phase of a sampling signal for time equivalent to 50 counts, the phase changes to the appropriate state at a stage of phase correction for 50/480 scan lines without waiting for one screen to be depicted.

As described above, the following advantages are obtained according to this embodiment.

(1) The dummy element 50 is provided on the glass substrate identical with the glass substrate on which the respective components of the liquid crystal panel 1 such as the sampling circuits SH1 to SHn are formed. Thus, the dummy element 50 includes parasitic capacitance, wire resistance, and the like same as those of the sampling circuits SH1 to SHn and the like and has a transmission characteristic of the timing signal substantially equivalent to that of the sampling circuit SH1 to SHn and the like.

Therefore, a change in a transmission characteristic of the internal circuit of the liquid crystal panel 1 due to influences of a temperature change and aged deterioration is reflected on the monitor signal MONI outputted through the dummy element 50.

The signal generating circuit 17 generates plural timing signals including the start signal DX with the horizontal synchronizing signal HSYNC as a trigger and with timing when the counter 19 ends count corresponding to an integrated count value as a start point and supplies the timing signals to the liquid crystal panel 1. Thus, the driving device 3 generates a start signal serving as a trigger for generating the plural timing signals at timing when time, which corresponds to an integrated count value obtained by adding phase comparison information outputted by comparing the phases of the monitor signal MONI and the reference signal REFE to the initial count value "Defv", elapses.

In the integrated count value, the phase comparison information of the reference signal having a phase fixed with the horizontal synchronizing signal HSYNC for taking depiction timing of an image as a trigger, the reference signal REFE, and the monitor signal MONI is added. Thus, the start signal DX generated at timing when time corresponding to the integrated count value elapses is corrected to be close to an appropriate phase state.

Moreover, the start signal DX with a phase corrected is outputted as the monitor signal MONI again through the dummy element 50 and the phase of the start signal DX is compared with the phase of the reference signal REFE by the phase comparator 14. In this way, feedback of a correction state of the start signal DX is repeated, whereby the start signal DX is corrected to a proper phase. Thus, it is possible to obtain a proper image without a ghost.

It is possible to constitute the components such as the signal generating circuit 17, the reference signal generating circuit 13, the phase comparator 14, and the adder 15, which constitute the driving device 3, using digital circuits that are highly integrated easily such as a frequency divider, a phase detector, a shift register, and a counter.

Thus, it is possible to store the driving device 3 in an integrated circuit formed of one chip.

Therefore, even if a characteristic of the internal circuit of the liquid crystal panel 1 changes because of influences of a temperature change and aged deterioration, it is possible to obtain, with a simple constitution, a clear image without a ghost.

(2) When a phase of the monitor signal MONI coincides with a phase of the reference signal REFE, the phase comparator 14 outputs data "00" indicating a "±0" value for "not changing an integrated count value" as the phase comparison information. When a phase of the monitor signal MONI is in advance of a phase of the reference signal REFE, the phase comparator 14 outputs data "01" indicating a "+1" value for "changing an integrated count value by one in a direction for delaying a phase". When a phase of the monitor signal MONI is delayed behind a phase of the reference signal REFE, the phase comparator 14 outputs data "11" indicating a "−1" value for "changing an integrated count value by one in a direction for advancing a phase". The adder 15 supplies a value obtained by adding a count value indicated by data serving as the phase comparison information to the initial count value "Defv" to the counter 19 as an integrated count value. Thus, when the start signal DX is in a proper phase state judging from a phase comparison result of the monitor signal MONI, the driving device 3 continues phase correction according to the last integrated count value. When a phase of the start signal DX shifts, the driving device 3 performs phase correction equivalent to a count time for each count by performing feedback once in order to bring the start signal DX close to the proper phase state.

The phase comparator 14 outputs only three data forms of "−1", "0", and "+1" as phase comparison information. Thus, the phase comparator 14 only has to have a simple constitution including a 2-bit data output function. Moreover, it is possible to constitute the adder 15 using a simple integration register capable of adding 2-bit data to an initial count value. Therefore, it is possible to provide the driving device for a liquid crystal panel with a simple constitution.

(3) Since the reference signal generating circuit 13 generates the reference signal REFE in synchronization with a quadrupled clock supplied from the multiplier 12, the driving device 3 can precisely set a phase of the reference signal REFE.

Since the counter 19 performs count according to the quadrupled clock, the driving device 3 can precisely perform, using the quadrupled clock, phase correction in a short time that cannot be adjusted with a period of the reference clock CLK because the period is too long.

Thus, it is possible to adjust plural timing signals including the start signal DX to a more appropriate phase state.

Therefore, the driving device 3 can obtain a clear image without a ghost even if a characteristic of the internal circuit of the liquid crystal panel 1 changes because of influences of a temperature change and aged deterioration.

(4) The initial count value "Defv" of the counter 19 is set to a count value within a range of about 20% to 80% of a total number of counts of the counter, there are fixed margins of count values on both a plus side and a minus side of the initial count value "Defv". Thus, when a phase of the start signal DX shifts judging from a phase comparison result of the monitor signal MONI, it is possible to adjust the phase with a fixed width with respect to both directions of phase advance and phase delay.

Therefore, the driving device 3 can correct phases of the plural timing signals including the start signal DX until the phases become appropriate in the both direction of phase advance and phase delay.

(5) The signal generating circuit 17 provides the predetermined time $\Delta t0$ with timing identical with a rising edge of the horizontal synchronizing signal HSYNC identical with a start point of the reference signal REFE as a start point before the counter 19 starts count corresponding to an integrated count value, causes the counter 19 to perform count corresponding to the integrated count value after the predetermined time $\Delta t0$ elapses, and generates the start signal DX with timing when the count ends as a start point. Thus, it is unnecessary to cover entire time until the timing when the start signal DX is generated with a count time of the counter 19.

Thus, it is possible to reduce the total number of counts of the counter 19. The counter 19 may be small.

Therefore, it is possible to provide the driving device 3 with a simple constitution.

(6) The predetermined time $\Delta t0$ is set to time during which, when the start signal DX generated with the horizontal synchronizing signal HSYNC as a trigger and with timing based on the initial count value "Defv" as a start point after the predetermined time $\Delta t0$ elapses is inputted to the liquid crystal panel 1 having a standard transmission characteristic, a phase of the monitor signal MONI outputted from the liquid crystal panel 1 substantially coincides with a phase of the reference signal REFE.

Therefore, the driving device 3 can adjust phases of the timing signals to an appropriate state even if the driving device 3 has a simple constitution including the small counter 19.

(7) When a phase shifts judging from a phase comparison result of the monitor signal MONI, the driving device 3 adjusts phases of the sampling signals S1 to Sn to a phase of an appropriate state by performing phase correction equivalent to a count time for each count per one scan line in order to bring the phase into the appropriate phase state. Moreover, when the phases of the sampling signals S1 to Sn change to phases of the appropriate state, since the state is kept, the driving device 3 can set the phases of the sampling signals S1 to Sn in the appropriate state at a stage in the course of displaying one screen and maintain the state.

Therefore, the driving device 3 can perform phase correction for timing signals quickly.

(8) The image display apparatus 100 includes the driving device 3 and the liquid crystal panel 1. Thus, it is possible to obtain a clear image without a ghost even if a characteristic of the internal circuit of the liquid crystal panel 1 changes because of influences of a temperature change and aged deterioration.

The invention is not limited to the embodiment described above. It is possible to apply various modifications, improvements, and the like to the embodiment. Modifications will be described below.

First Modification

A first modification will be explained with reference to FIGS. 1 and 2. In the embodiment described above, the driving device 3 is explained as including the multiplier 12. However, the invention is not limited to this. For example, the multiplier 12 may be included in the clock supply unit 9.

In the case of this constitution, the clock supply unit 9 generates a quadrupled clock from the reference clock CLK using a multiplier built in the clock supply unit 9 and supplies the quadrupled clock to the driving device 3 together with the reference clock CLK.

Consequently, since the quadrupled clock is supplied to the driver 3, it is possible to obtain the same advantage as the embodiment.

Second Modification

A second modification will be explained with reference to FIG. 1. Examples of a specific product form of the image display apparatus 100 in the embodiment include a personal computer, a liquid crystal television, a cellular phone, a Personal Digital Assistance (PDA), and a liquid crystal projector.

In particular, the invention is suitable for a so-called "liquid crystal three-plate type projector" that separates white light radiated by a lamp serving as a light source into three primary color components of light of red light, blue light, and green light, modulates the respective color lights into image signals with liquid crystal light bulbs for the respective color lights serving as optical modulators, and combines the image signals again to project a full color image.

When the image display apparatus 100 is the liquid crystal three-plate type projector, the driving device 3 is provided for each of the liquid crystal light bulbs for red light, blue light, and green light. Consequently, it is possible to obtain a clear projected image without a ghost even if a characteristic of internal circuits of the respective color light liquid crystal light bulbs changes because of influences of a temperature change and aged deterioration.

What is claimed is:

1. A driving device for a liquid crystal panel that includes: plural liquid crystal cells arranged in a matrix shape; pixel electrodes provided for the respective liquid crystal cells; plural data lines for inputting an image signal to the respective pixel electrodes; a data line driver that generates a sampling signal for sampling the image signal from inputted plural timing signals; plural sampling circuits provided for the respective data lines that sample the image signal according to the sampling signal and output the image signal to the data lines; and a dummy element formed on a substrate identical with a substrate on which the sampling circuits are formed, the driving device for a liquid crystal panel comprising:

a signal generating circuit that generates a plurality of timing signals including at least a start signal and at least one other signal using the start signal as a reference of a phase;

a reference signal generating circuit that generates a reference signal, the generation of the reference signal being triggered by a horizontal synchronized signal of an image signal, and the reference signal being generated after the elapse of a predetermined time from the triggering horizontal synchronized signal;

a phase comparator that compares phases of a monitor signal and the reference signal and outputs phase comparison information, wherein the monitor signal is the start signal changed via the dummy element; and an adder that outputs an integrated count value for adjusting timing for generating the start signal on the basis of an initial count value set in advance and the phase comparison information from the phase comparator, wherein the signal generating circuit generates plural timing signals including the start signal with the horizontal synchronizing signal as a trigger and with timing based on the integrated count value as a start point and supplies the timing signals to the liquid crystal panel.

2. The driving device for a liquid crystal panel according to claim 1, wherein the phase comparator outputs data for not changing the integrated count value when a phase of the monitor signal coincides with a phase of the reference signal, the phase comparator outputs data for changing the integrated value by one in a direction for delaying a phase when a phase of the monitor signal is in advance of the phase of the reference signal, the phase comparator outputs data for changing the integrated count value by one in a direction for advancing a phase when a phase of the monitor signal is delayed behind the reference signal, the adder adds an integrated value, of a value indicated by data serving as the phase comparison information, to the initial count value, and the adder supplies the calculated value to the counter as the integrated count value.

3. The driving device for a liquid crystal panel according to claim 1, further comprising a multiplier that generates a predetermined multiplied clock signal by multiplying a reference clock signal, the multiplied clock signal being used for synchronizing the plural timing signals including the start signal, wherein the reference signal generating circuit generates a reference signal in synchronization with the multiplied clock signal, and the counter performs count according to the multiplied clock signal.

4. The driving device for a liquid crystal panel according to claim 1, wherein the initial count value of the counter is set to a count value within a range of about 20% to 80% of a maximum potential number of counts of the counter.

5. The driving device for a liquid crystal panel according to claim 1, wherein the signal generating circuit includes a counter, provides a predetermined time with the horizontal synchronizing signal as a trigger, causes the counter to perform count corresponding to the integrated count value after the predetermined time elapses, and generates the start signal with timing when the count ends.

6. The driving device for a liquid crystal panel according to claim 5, wherein a predetermined time for generating the reference signal is set such that a phase of the monitor signal outputted from the liquid crystal panel substantially coincides with a phase of the reference signal.

7. An image display apparatus comprising:

the driving device for a liquid crystal panel according to claim 1; and the liquid crystal panel.

* * * * *

UNITED STATES PATENT AND TRADEMARK OFFICE

CERTIFICATE OF CORRECTION

PATENT NO. : 7,659,874 B2
APPLICATION NO. : 11/356001
DATED : February 9, 2010
INVENTOR(S) : Fumio Koyama It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1029 days.

Signed and Sealed this

Twenty-eighth Day of December, 2010

David J. Kappos

David J. Kappos
*Director of the United States Patent and Trademark Office*